US008006610B2

(12) United States Patent
Dreher et al.

(10) Patent No.: US 8,006,610 B2
(45) Date of Patent: Aug. 30, 2011

(54) AXIAL PISTON MACHINE IN A SWASH-PLATE CONSTRUCTION HAVING AN ADJUSTING DEVICE

(75) Inventors: Herbert Dreher, Horb (DE); Clemens Krebs, Tuebingen (DE); Timo Nafz, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 52 days.

(21) Appl. No.: 12/710,050

(22) Filed: Feb. 22, 2010

(65) Prior Publication Data

US 2010/0206161 A1 Aug. 19, 2010

Related U.S. Application Data

(63) Continuation of application No. PCT/EP2008/006850, filed on Aug. 20, 2008.

(30) Foreign Application Priority Data

Aug. 20, 2007 (DE) ..... 10 2007 039 173

(51) Int. Cl.
*F01B 13/04* (2006.01)

(52) U.S. Cl. ..... 92/12.2; 91/505

(58) Field of Classification Search ..... 92/12.2, 92/13; 91/504, 505

See application file for complete search history.

(56) References Cited

U.S. PATENT DOCUMENTS

| | | | | |
|---|---|---|---|---|
| 3,234,889 | A * | 2/1966 | Cooper et al. | 92/12.2 |
| 5,794,515 | A * | 8/1998 | Bethke | 92/12.2 |
| 6,705,203 | B2 * | 3/2004 | Boone | 92/12.2 |
| 7,367,258 | B2 * | 5/2008 | Wanschura et al. | 92/12.2 |

FOREIGN PATENT DOCUMENTS

| | | |
|---|---|---|
| DE | 37 33 625 A1 | 2/1989 |
| DE | 39 35 800 A1 | 5/1991 |
| DE | 42 03 619 A1 | 8/1993 |
| DE | 42 29 007 A1 | 3/1994 |
| EP | 1 462 647 A2 | 9/2004 |

* cited by examiner

*Primary Examiner* — Michael Leslie

(74) *Attorney, Agent, or Firm* — Muncy, Geissler, Olds & Lowe, PLLC

(57) ABSTRACT

An axial piston machine in a swash-plate construction with an actuating device. The actuating device comprises a actuating piston and a mating piston. The actuating piston and the mating piston are connected to the swash plate each with the first end thereof and can be applied with the second end thereof with a force acting in the direction of the first end. For resetting the swash plate in the direction of a resting position, an elastic element is provided on the actuating piston and on the mating piston, which is supported on a spring bearing arranged on the first side facing the swash plate of the actuating piston or of the mating piston. In the other direction, the elastic element is supported on a second spring bearing arranged on the end facing away from the swash plate of the actuating piston or of the mating piston. When the swash plate is deflected from the resting position, the second spring bearing of the actuating piston or of the mating piston is supported on a counter bearing on the housing side. The second spring bearing of the respective other actuating bearing or mating bearing is supported on a counter bearing on the piston side.

6 Claims, 4 Drawing Sheets

AXIAL PISTON MACHINE IN A SWASH-PLATE CONSTRUCTION HAVING AN ADJUSTING DEVICE

This nonprovisional application is a continuation of International Application No. PCT/EP2008/006850, which was filed on Aug. 20, 2008, and which claims priority to German Patent Application No. 10 2007 039 173.2, which was filed in Germany on Aug. 20, 2007, and which are both herein incorporated by reference.

BACKGROUND OF THE INVENTION

1. Field of the Invention

The invention relates to an axial piston machine in a swash-plate construction having an adjusting device.

2. Description of the Background Art

Axial piston machines comprise a plurality of pistons which are disposed so as to be longitudinally displaceable in a cylinder drum mounted in a rotatable manner. The pistons are supported on a swash-plate or pivot cradle, whose angle of inclination can be adjusted with respect to the rotational axis of the cylinder drum. The displaced volume changes in dependence upon the angle of inclination. An adjusting device is provided to adjust the angle of inclination of the swash-plate. This adjusting device can consist for example of an adjusting piston for changing the angle of inclination in a first direction and of a counter-piston for changing the angle of inclination of the swash-plate in the opposite direction. In order to achieve a defined end position of the swash-plate in a pressure-less system and without the actuation of actuating means, the adjusting piston and/or the counter-piston are generally (each) influenced with the force of a spring. In the case of a thus produced balance of forces, the swash-plate is in the end position of the axial piston machine. This rest position can be a neutral position for example in the case of an axial piston machine which can be adjusted in two directions, in which neutral position a zero stroke of the pistons thus occurs when the cylinder drum rotates.

The return springs are conventionally disposed in an internal space, which can be pressurised and is delimited on one side by the adjusting piston/counter-piston, and thus act on the side of the adjusting piston/counter-piston. If, however, the adjusting piston and the counter-piston are integrated in the axial piston machine then the constructional length of the entire machine is increased as a result.

SUMMARY OF THE INVENTION

It is the object of the invention to provide an axial piston machine in a swash-plate construction having an adjusting device in which the provided constructional space is utilised in an advantageous manner and which moreover can be assembled in a simple manner.

The axial piston machine in accordance with an embodiment of the invention can be formed in a swash-plate construction having an adjusting device. The adjusting device includes an adjusting piston and a counter-piston, wherein the effective direction of the adjusting piston and that of the counter-piston are opposite each other with regard to a movement of the swash-plate. The adjusting piston and also the counter-piston each co-operate at their first ends with the swash-plate and can transfer a thrust thereto. At their respective second ends, the adjusting piston and also the counter-piston are individually influenced with a control force. In order to return the swash-plate in the direction of a rest position, which can coincide with a neutral position but does not have to do so, a resilient element is provided in each case on the adjusting piston and also on the counter-piston. This resilient element, preferably configured as a helical spring, is supported on a first spring bearing which is disposed on the side of the adjusting piston/counter-piston facing the swash-plate. On the end remote from the swash-plate, the resilient element is supported in each case on a second spring bearing. When the swash-plate is deflected from the rest position, either the second spring bearing of the adjusting piston or the second spring bearing of the counter-piston depending upon the direction of deflection of the swash-plate is supported on a counter-bearing which is fixed on the housing-side. In contrast, the respective other second spring bearing of the counter-piston or adjusting piston is supported on a counter-bearing fixed on the piston-side.

By disposing the return springs in a region of the adjusting piston/counter-piston formed between the first end and the second end, it is not necessary to increase the constructional length of the axial piston machine in the axial direction. The use of two return springs so that in each case only one of the return springs is compressed by the housing-side abutment when the swash-plate is deflected out of its rest position, is advantageous in that a housing-side counter-bearing only has to be provided for one direction of movement in each case for the adjusting piston and for the counter-piston. If the direction of movement of this adjusting piston or counter-piston is in the opposite direction, then in contrast the respective return spring is simultaneously moved between the first spring bearing and the second spring bearing in a restrained manner, and is then supported on a counter-bearing provided on the respective piston. This arrangement additionally permits the entire adjusting device, including the return springs, to be preassembled before the driving mechanism of the axial piston machine is inserted into the housing.

In order to form the counter-bearing, fixed on the housing-side, for the return spring, a support ring is preferably provided which is penetrated by the adjusting piston/counter-piston. The inner diameter of the support ring is smaller than the radial extension of the respective second spring bearing. This support ring can either be fixedly mounted in the housing so long as the diameter of the adjusting piston/counter-piston penetrating the support ring is small enough to allow such a mounting arrangement. In contrast, in accordance with an alternative embodiment, which is used particularly in the case of large piston diameters of the second end of the adjusting piston/counter-piston, a hold-down spring is disposed between the support ring—penetrated by the adjusting piston/counter-piston—and the second spring bearing. This hold-down spring holds the support ring in abutment against a bearing surface, formed in the housing of the axial piston machine, in any position of the swash-plate, and thus of the adjusting piston and of the counter-piston, occurring during operation of the axial piston machine. Such a procedure is advantageous in that it is not necessary to preassemble the support ring in the housing of the axial piston machine, and in particular subsequent fixing after assembly of the adjusting piston/counter-piston is also not required.

The support ring can have a radial extension which is greater than the adjusting pressure chamber diameter of the adjusting piston/counter-piston, and the through-going aperture thereof which is penetrated by the adjusting piston/counter-piston is smaller than the second end of the associated adjusting piston or counter-piston.

In order to simplify assembly, a centring device is formed on the second end of the adjusting piston on a side facing the first end of the second adjusting piston. The support ring is provided with a geometry corresponding thereto and the support ring is held in abutment against it by the hold-down spring during preassembly. In this defined position, the support ring can be simply assembled by way of the introduction of the adjusting piston/counter-piston into the bore of the housing provided for this purpose. The centring device is provided at a location of the adjusting piston which at no point in time comes into contact with the corresponding geometry of the support ring during operation of the machine which means that secure fixing of the support ring to the bearing surface is ensured by the hold-down spring.

The support ring preferably partly closes a bore in which the second end of the adjusting piston or of the counter-piston is received in order to form therein an adjusting pressure chamber or a working pressure chamber. By way of this partial closure of the bore it is possible to use a spring plate as the second spring bearing, the diameter of which being smaller than the diameter of the bore. By using such a smaller spring plate the required movement clearance is created which means that a collision between the spring plate and the cylinder drum is reliably precluded independent of the position of the swash-plate. It is preferred to provide apertures in the support ring which connect an internal space in the bore, which internal space is rearward with respect to the second end of the adjusting piston/counter-piston, to the remaining internal space of the housing. Such a diameter-reducing support ring is used in particular on the side of the adjusting piston whose diameter is generally greater than that of the counter-piston.

The following description relates to an exemplified embodiment of an axial piston machine in accordance with the invention having an adjusting piston having a large piston diameter and a counter-piston having a diameter which is clearly reduced with respect thereto in each case at their second end. Hereinafter, it is shown merely for the adjusting piston that a support ring is used for the piston diameter reduction in order to be able to use a spring plate as a second spring bearing with a comparatively small diameter. However, it is also feasible on the part of the counter-piston that owing to the diameter of the counter-piston, the diameter of the bore which receives it is so large that a support ring is also used at that location, which support ring is disposed in a comparable manner and is held by a hold-down spring.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
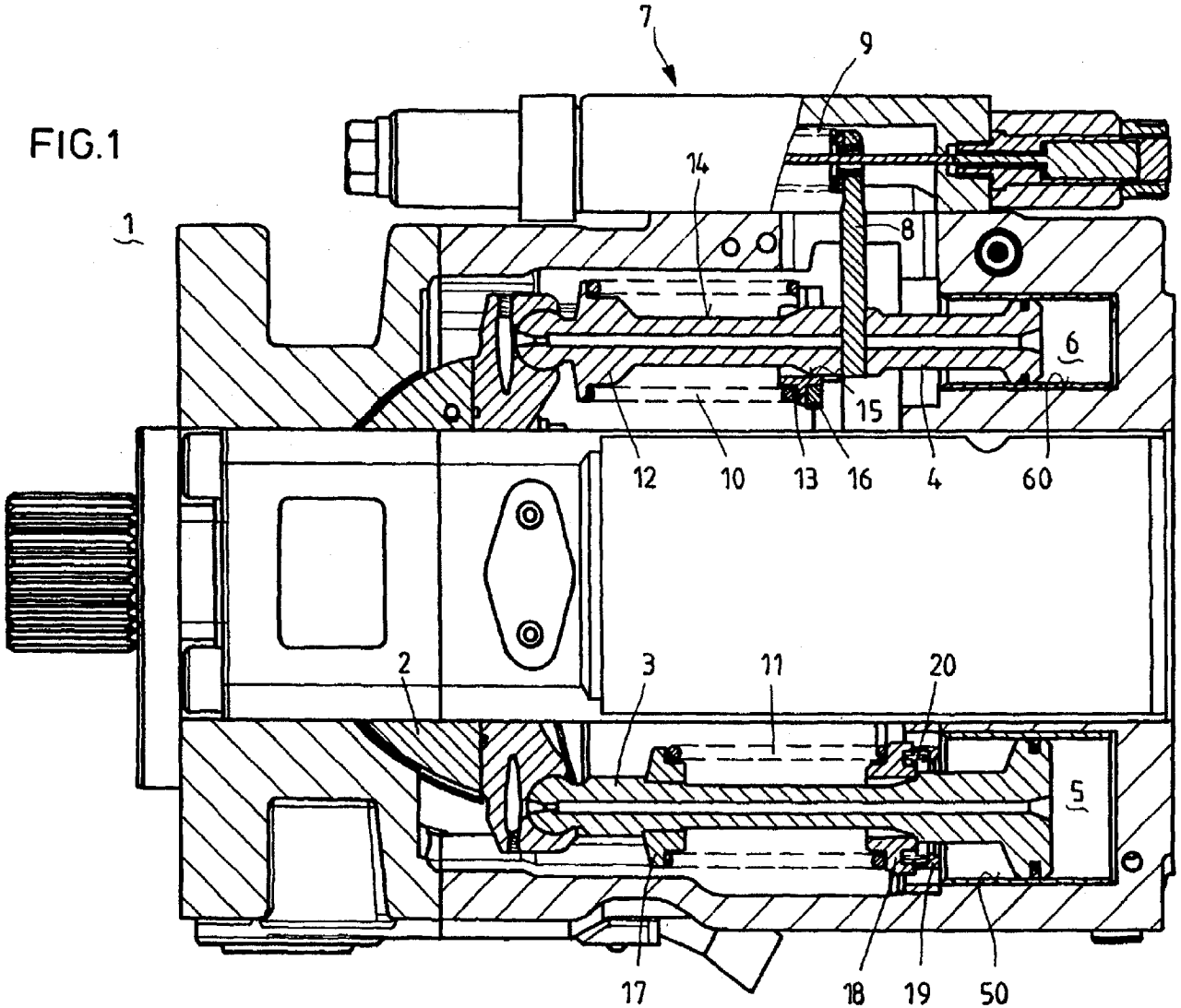
FIG. 1 shows a stepped partial section through an axial piston machine in accordance with the invention.

FIG. 1 shows a section, progressing in steps, through an axial piston machine 1 in accordance with the invention. The upper half of FIG. 1 extends along a first sectional plane which is in parallel with the sectional plane of the lower half of the axial piston machine. The two sectional planes are perpendicular to an axis of rotation of the swash-plate which is designed as a pivot cradle 2 in the illustrated exemplified embodiment. However, it is just as feasible to dispose the adjusting device having an adjusting piston 3 and a counter-piston 4 in one plane. From a space-saving point of view, however, the offset arrangement is preferred. The adjusting piston 3 and the counter piston 4 each comprise a first end which is connected in each case via a ball and socket joint to a hold-down segment in each case. The hold-down segments are for their part fixedly connected, e.g., screwed, to the pivot cradle 2. A thrust can be transferred to the pivot cradle through the adjusting piston 3 and is used to rotate the pivot cradle 2 in the clockwise direction in the illustrated exemplified embodiment.

A force acting in the opposite direction can be transferred to the pivot cradle 2 by the thrust which can be transferred by the counter-piston 4. As a result, the pivot cradle 2 is pivoted in the anticlockwise direction against the previously described movement.

In order to produce the adjusting forces required to move the pivot cradle 2, two blind bores 50 and 60 are provided in the housing of the axial piston machine 1. A second end of the adjusting piston 3 and counter-piston 4 is in each case disposed in the blind bores 50 and 60 respectively. In the case of the adjusting piston 3, an adjusting pressure chamber 5 is thus formed in the housing of the axial piston machine 1. In contrast, the counter-piston 4 delimits a working pressure chamber 6. The diameter of the second end of the counter-piston 4 is smaller than the diameter of the adjusting piston 3. Whilst the working pressure chamber 6 is permanently connected for example to a delivery pressure of an axial piston machine 1 designed as a pump, the pressure prevailing in the adjusting pressure chamber 5 can be adjusted by means of a regulating valve 7. It can be adjusted for example between a pressure reduced from the working line pressure and the reservoir pressure.

Whilst the working line pressure in the working pressure chamber 6 always acts upon the counter-piston 4, the hydraulic force acting upon the adjusting piston 3 can be adjusted at the second end of the adjusting piston 3. If the hydraulic force acting at that location exceeds the hydraulic force on the counter-piston 4 in the working pressure chamber 6 then an adjusting movement of the pivot cradle 2 in the clockwise direction is produced.

An electro-proportional adjustment is shown in FIG. 1 in which the position of the pivot cradle 2 is fed back to the regulating valve 7 via a feedback lever 8 and a feedback spring 9. Such adjusting mechanisms are known per se for which reason further details in this regard are unnecessary. In the case of disappearing control signals, the regulating valve 7 is in a neutral position in which a pressure averaged from the reservoir pressure and the reduced working pressure $$P_5 = \frac{A_6}{A_5} \cdot P_6 \quad \text{(eq. 1)}$$

prevails in the adjusting pressure chamber 5. The centring springs have only one function in the pressure-less state. In the pressure-less state, the pivot cradle 2 is moved to a rest position owing to the returning force of a first return spring 10 or a second return spring 11. The first return spring 10 is configured as a helical spring and surrounds a part of the counter-piston 4. A first spring bearing 12 is formed on the counter-piston 4 for this purpose. This first spring bearing 12 is disposed in proximity to the ball and socket joint, i.e., the first end of the counter-piston 4. In the illustrated exemplified embodiment, the first spring bearing 12 is produced for example by machining a counter-piston blank. The first return spring 10 is supported on a second spring bearing 13 in the direction of the second end of the counter-piston 4. A radially tapered region 14 is formed on the counter-piston 4 and the second spring plate 13, configured in a slotted manner, is slid onto this region. The counter-piston 4 is in turn radially extended in the direction towards the second end of the counter-piston 4 so that a piston-side counter-bearing 15 for the second spring bearing 13 is formed on the counter-piston 4. Starting from this counter-bearing 15, the second spring bearing 13 can be displaced in the axial direction over the radially tapered region 14 of the counter-piston 4. The spaced disposition between the first spring bearing 12 and the piston-side counter-bearing 15 is dimensioned such that the first return spring 10 is pre-stressed in any position of the counter-piston 4.

In order to compress the first return spring 10 upon an adjusting movement of the pivot cradle 2 in the clockwise direction, a housing-side counter-bearing is also provided. This housing-side counter-bearing is in the form of a support ring 16 which is fixed (e.g., screwed) in the housing of the axial piston machine 1. An inner diameter of the support ring 16 is dimensioned such that the second end of the counter-piston 4 can be inserted through the support ring 16 into the blind bore 60 to form the working pressure chamber 6. Such a formation is always possible if the diameter of the working pressure chamber 6 is so small that the second end of the counter-piston 4 can be inserted through the support ring 16. If so, the support ring 16 can be fixed in the housing of the axial piston machine 1 prior to assembling the driving mechanism and the counter-piston 4.

In contrast, if the swash plate moves from its rest position shown in FIG. 1 in the anticlockwise direction during operation of the axial piston machine 1 owing to the adjusting pressure chamber 5 being relieved, then the second spring plate 13 lies against the piston-side counter-bearing 15. In the case of such a movement, the hydraulic force on the second end of the counter-piston 4, owing to the adjusting pressure chamber 5 being relieved, is greater than the sum of the hydraulic force on the second end of the adjusting piston 3 and the force of the second return spring 11. Consequently, the counter-piston 4 moves to the left in FIG. 1 and the first return spring 10 restrained between the first spring bearing 12 and the second spring bearing 13 is moved with the counter-piston 4 without compression.

A first spring bearing 17 and a second spring bearing 18 are also provided for the second return spring 11 which is likewise configured as a helical spring and surrounds the adjusting piston 3. However, owing to the diameter of the bore 50 in which the adjusting pressure chamber 5 is formed by the second end of the adjusting piston 3, and owing to the diameter—associated therewith—of the second end of the adjusting piston 3, the support ring 19 in this case cannot be configured such that the second end of the adjusting piston 3 can be inserted through the support ring 19 into the bore 50 in the housing of the axial piston machine 1. Such a large inner diameter of the support ring 19 would result in the fact that an extremely large second spring bearing 18 would have to be used. However, the size of the spring bearing 18 would then result in it colliding with the driving mechanism of the axial piston machine 1. In order to prevent, in the case of a reduction in the outer diameter of the second spring bearing 18 of the adjusting piston 3, the second spring bearing 18 from entering the bore 50 to form the adjusting pressure chamber 5, the bore 50 is thus partly covered by the support ring 19. However, since the second end of the adjusting piston 3 can now no longer be inserted through the support ring 19 into the bore 50, it is not possible to preassemble the support ring 19 in the housing of the axial piston machine 1 prior to insertion of the adjusting piston 3. The support ring 19 is thus first slid onto the adjusting piston 3 from the first end of the adjusting piston 3. A hold-down spring 20 is disposed between the support ring 19 and the second spring bearing 18 and during operation of the axial piston machine 1 permanently holds the support ring 19 in abutment against a bearing surface which is formed on the axial piston machine 1 on the housing-side. This will be explained in further detail hereinafter with reference to FIG. 2.

The second end of the adjusting piston 3 has a diameter which corresponds with the diameter of the bore 50 or with an inner diameter of a bushing disposed therein. The second end of the adjusting piston 3 thus delimits an adjusting pressure chamber 5 in the bore 50. The diameter of the adjusting piston 3 is tapered starting from the second end of the adjusting piston 3.

Figure 2:
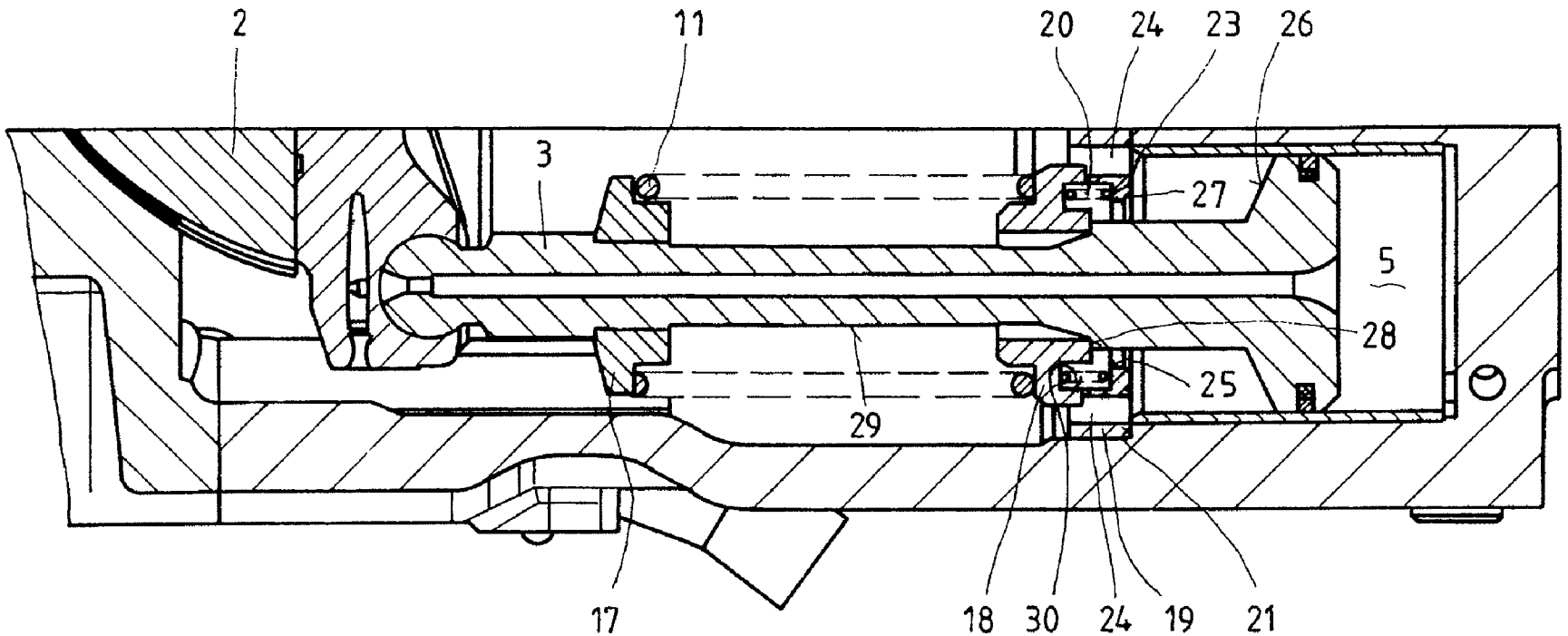
FIG. 2 shows an enlarged illustration of the region of the adjusting piston in a rest position of the axial piston machine.

Upon assembly of the axial piston machine 1, the support ring 19 is firstly slid onto the adjusting piston 3 from the first end of the adjusting piston 3. Then, the hold-down spring 20 is slid over the adjusting piston 3, followed by the second spring bearing 18. The support ring 19 and the second spring bearing 18 each have an inner diameter which is greater than the first end of the adjusting piston 3. The inner diameter of the second spring bearing 18 is smaller than the inner diameter of the support ring 19. A shoulder 28 formed on the adjusting piston 3 in proximity to the second end thus forms a piston-side counter-bearing for the second spring bearing 18. After placement of the second spring bearing 18, the second return spring 11 is placed. Finally, the first spring bearing 17 is assembled. In order to attach the first spring bearing 17 to the adjusting piston 3, a shoulder is also formed on the first end of the adjusting piston 3 as a counter-bearing for the first spring bearing 17. The first spring bearing 17 is configured so as to be radially slotted in a manner known per se so that it can be slid into a central, radially tapered region 29 of the adjusting piston 3. By way of the spring force of the second return spring 11, it is brought into abutment with the shoulder of the adjusting piston 3 when the axial piston machine 1 is in the assembled state, as illustrated in FIG. 2. In this position, the diameter of the adjusting piston 3 is greater than the width of the slots so that a radial offset is prevented during operation. In dependence upon the position of the pivot cradle 2 and thus the position of the adjusting piston 3, the second spring bearing 18 is supported, as previously explained in relation to the counter-piston 4, either on the piston-side counter-bearing 28 or on the housing-side counter-bearing in the form of the support ring 19. Independently of the position of the adjusting piston 3 relative to the support ring 19, the hold-down spring 20 ensures that the support ring 19 is always in abutment with a bearing surface 21 which is formed on the housing-side. The hold-down spring 20 has a clearly smaller spring constant in comparison with the return springs 10, 11.

In order to be able to ensure a secure assembly of the support ring 19, wherein the positioning must be effected solely by way of the insertion of the second end of the adjusting piston 3 into the bore 50, a centring device 26 is formed on the second end of the adjusting piston 3 on a side facing the first end. This centring device 26 is a truncated cone-shaped section which co-operates with a corresponding geometry 27 on the part of the support ring 19. The corresponding geometry 27 is formed by a chamfer in the region of the through-going aperture 25 of the support ring 19. After assembly of the first spring bearing 17, the hold-down spring 20 holds the support ring 19 having the corresponding geometry 27 in abutment against the peripheral surface of the truncated cone-shaped section of the adjusting piston 3. The support ring 19 thus has a defined position and automatically lies against the bearing surface 21 when the second end of the adjusting piston 3 is inserted into the bore 50 during assembly of the axial piston machine 1.

Figure 3:
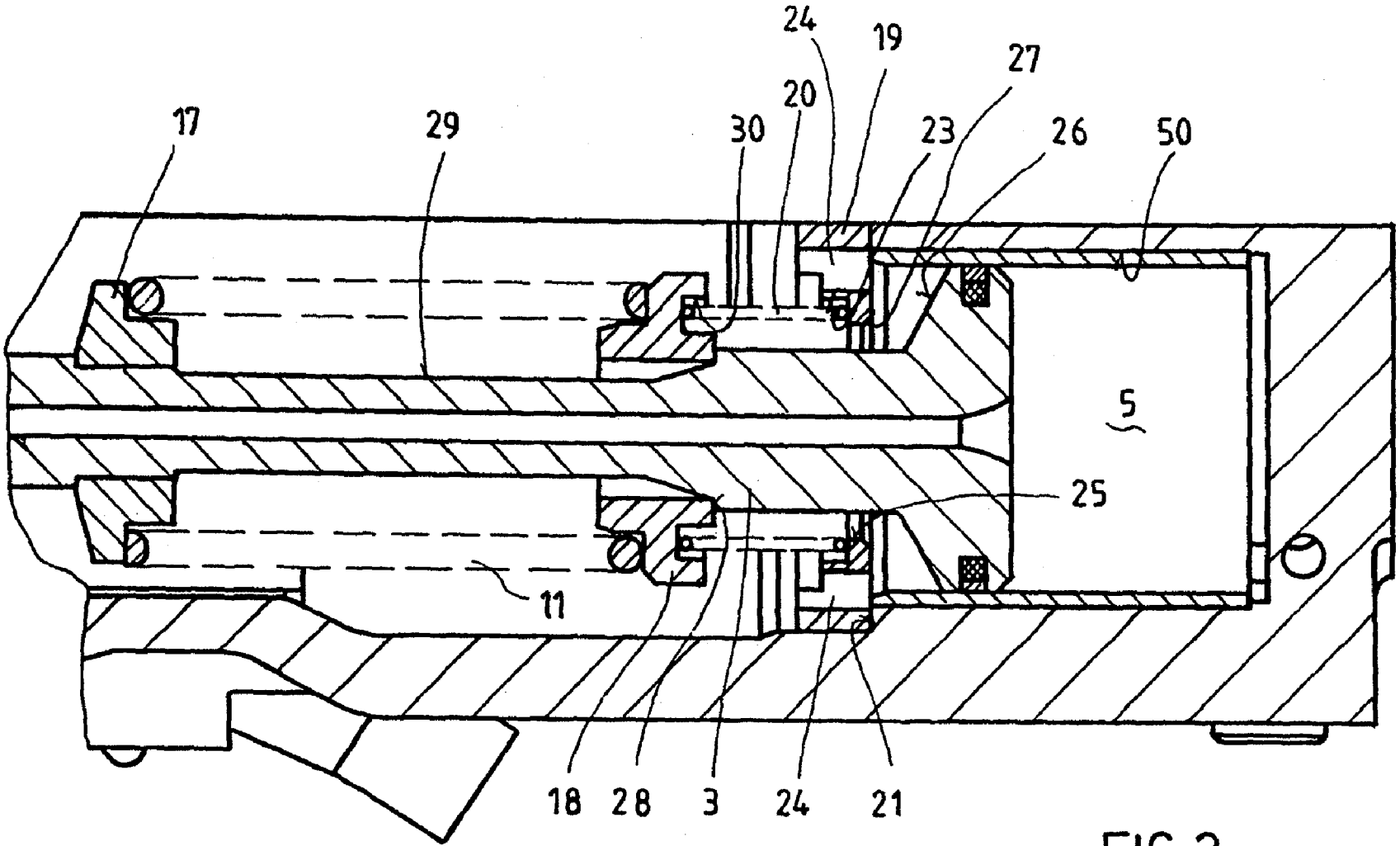
FIG. 3 shows an enlarged illustration of the region of the adjusting piston in a first end position of the swash-plate.

The enlarged region of FIG. 2 is once again illustrated in FIG. 3 when the swash-plate 2 has been pivoted out of its rest position in the clockwise direction. Accordingly, the adjusting piston 3 is further to the left in FIG. 3 than in FIG. 2. Owing to the force of the hold-down spring 20, the support ring 19 remains in abutment with the bearing surface 21. When the pivot cradle 2 has been displaced to the maximum extent in the clockwise direction, a spaced disposition still remains between the centring device 26 of the adjusting piston 3 and the corresponding geometry 27 of the support ring 19. In this manner it is ensured that an adjusting movement does not result in an accidental movement of the support ring 19 through the second end of the adjusting piston 3. Recesses are preferably provided in the support ring 19 and also in the second spring bearing 18 to receive the hold-down spring 20. These are provided in the form of grooves or steps which are disposed in the mutually facing end sides of the second spring bearing 18 and of the support ring 19. In the illustrated exemplified embodiment, the second spring bearing 18 comprises a groove 30 whilst a step 23 is formed on the support ring 19.

Figure 4:
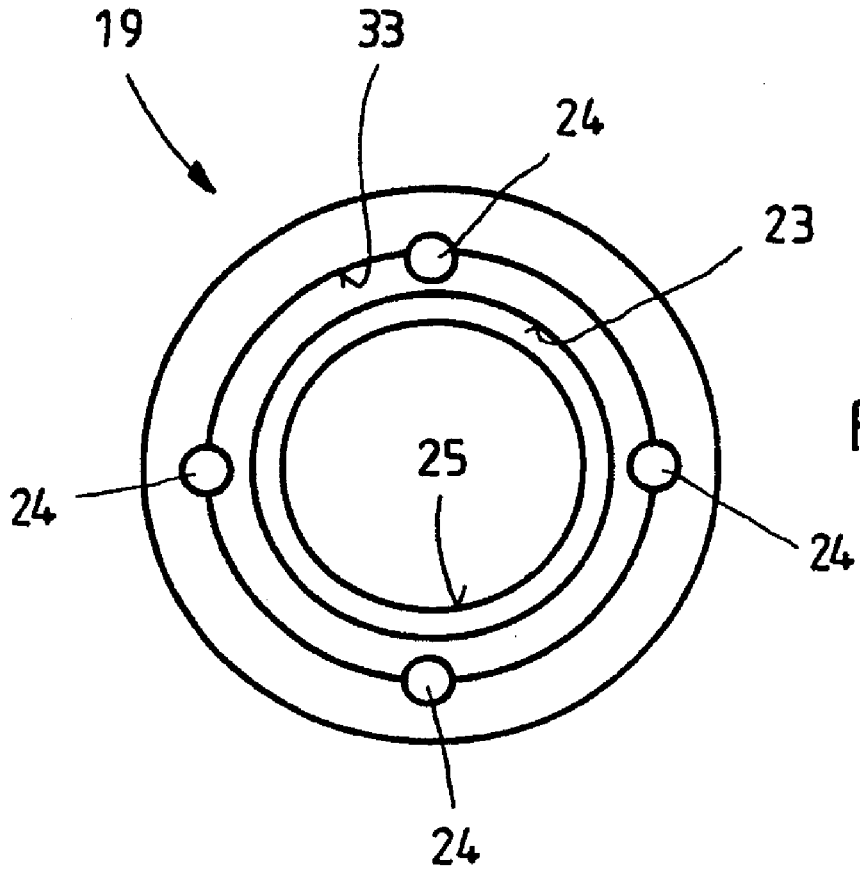
FIG. 4 shows a first view of a support ring configured in accordance with the invention.

FIG. 4 illustrates a view of the side of the support ring 19 facing the first end of the adjusting piston 3. It can be seen that several equalisation apertures 24 are provided distributed over the periphery. These equalisation apertures 24 are used to connect the internal space—formed in the bore 50 on the side of the second end 2 facing the first end of the adjusting piston 3—to the remaining internal space of the housing. As a result, a pressure equalisation can be effected in the bore 50 upon movement of the adjusting piston 3.

It is to be noted that the second end of the adjusting piston 3 is sealed with respect to the bore 50 for example using a piston ring. In the illustrated exemplified embodiment, a bushing is inserted into the bore 50, the adjusting piston 3 being able to slide in the bushing with reduced friction.

In order to fix the position of the housing-side counter-bearing for the second spring bearing 18, a further shoulder 33 is formed in the support ring 19 in the illustrated exemplified embodiment. However, it can be easily understood that such a shoulder does not absolutely have to be provided since the second spring bearing 18 can also be supported on a non-stepped end side of the support ring 19. However, in the case of the further shoulder 33, an additional centring process of the spring bearing 18 takes place.

As can be clearly seen from the drawings, all of the spring bearings are configured in the illustrated exemplified embodiment such that they comprise an extension, by means of which they engage into the feedback springs 10 or 11 configured as helical springs. In this manner, the feedback springs 11 and 12 are aligned with respect to the adjusting piston 3 and counter-piston 4 respectively.

Figure 5:
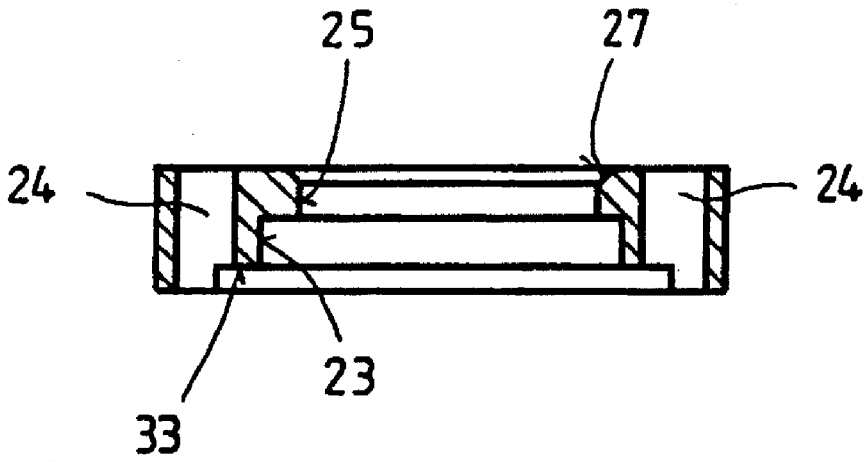
FIG. 5 shows a sectional illustration through a support ring of the axial piston machine in accordance with the invention.

Finally, FIG. 5 shows a section through the support ring 19 which once again shows the different diameters of the further shoulder 33, the through-going aperture 25 and the step 23 for receiving the hold-down spring 20. In addition, it can be clearly seen that on the side facing the second end of the adjusting piston 3 a bevel is formed as the corresponding geometry 27 with respect to the conical centring device 26.

All of the features explained only in relation to the counter-piston 4 or the adjusting piston 3 can also be applied to the other piston in each case.

The invention is not limited to the illustrated axial piston machine. On the contrary, the features shown in particular in conjunction with the first adjusting piston and the second adjusting piston or the arrangement of the return springs can also be combined with each other in an advantageous manner.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An axial piston machine in a swash-plate construction comprising an adjusting device comprising:

an adjusting piston;

a counter-piston that cooperates with the swash-plate at respective first ends of the adjusting piston and the counter-piston and are configured to be influenced at respective second ends of the adjusting piston and the counter-piston with a force acting in a direction of the first end; and a resilient element configured to return the swash-plate in a direction of a rest position, the resilient element being provided in each case on the adjusting piston and on the counter-piston and being supported in each case on a first spring bearing disposed on an end of the adjusting piston or the counter-piston facing the swash-plate, and in each case on a second spring bearing disposed on the adjusting piston or on the counter-piston at a point further away from the swash-plate, wherein upon deflection of the swash-plate from the rest position, the second spring bearing of the adjusting piston or of the counter-piston is supported on a counter-bearing fixed on the housing-side, while the second spring bearing of the respective other counter-piston or adjusting piston is supported on a counter-bearing fixed on the piston-side.

2. The axial piston machine as claimed in claim 1, wherein a support ring is provided in each case to form the counter-bearing fixed on the housing-side and is penetrated by the adjusting piston or the counter-piston.

3. The axial piston machine as claimed in claim 2, wherein a hold-down spring is disposed at least between a support ring and the second spring bearing allocated to the same adjusting piston or counter-piston and in any position of this adjusting piston or counter-piston holds the support ring in abutment with a bearing surface formed on the housing-side.

4. The axial piston machine as claimed in claim 3, wherein the support ring has an outer, radial extension which is greater than an adjusting pressure chamber diameter and has a through-going aperture which is smaller than the adjusting pressure chamber diameter in which the second end of the associated adjusting piston or counter-piston is disposed.

5. The axial piston machine as claimed in claim 3, wherein a centring device is formed on the second end of the adjusting piston on the side facing the first end and co-operates in a centring manner with a corresponding geometry on the support ring for the purpose of simple assembly, wherein the centring device is formed in the axial direction on the adjusting piston such that during operation of the axial piston machine a spaced disposition always remains between the centring device and the support ring.

6. The axial piston machine as claimed in claim 2, wherein the support ring partly closes a bore for receiving the second end of the adjusting piston or the counter-piston, wherein at least one equalisation aperture is provided in the support ring and connects the bore to the remaining internal space of the housing.

* * * * *